United States Patent [19]

Saringer et al.

[11] Patent Number: 5,067,479

[45] Date of Patent: Nov. 26, 1991

[54] CONTINUOUS PASSIVE MOTION DEVICE

[75] Inventors: John Saringer, Markham; Andrew Galbreath, Toronto, both of Canada

[73] Assignee: Toronto Medical Corp., Pickering, Canada

[21] Appl. No.: 570,550

[22] Filed: Aug. 21, 1990

[51] Int. Cl.[5] ..... A61H 1/02

[52] U.S. Cl. ..... 128/26; 128/25 R; 128/45

[58] Field of Search ..... 128/26, 25 R, 24 R, 128/44, 45, 46, 48, 51, 56, 61, 25 B

[56] References Cited

U.S. PATENT DOCUMENTS

| | | | |
|---|---|---|---|
| 826,879 | 7/1906 | Pelissier | 128/26 |
| 1,061,003 | 5/1913 | Ostrovsky | 128/26 |
| 1,688,188 | 10/1928 | Jugo | 128/26 |
| 1,833,357 | 11/1929 | Enzler . | |
| 2,832,334 | 4/1958 | Whitelaw | 128/25 R |
| 3,370,584 | 2/1968 | Girten | 128/25 R |
| 3,605,733 | 9/1971 | Sukle | 128/26 |
| 3,707,963 | 1/1973 | Keropian | 128/26 X |
| 3,756,222 | 9/1973 | Ketchum | 128/26 |
| 4,368,728 | 1/1983 | Pasbrig | 128/26 |
| 4,474,176 | 10/1984 | Farris et al. . | |
| 4,538,595 | 9/1985 | Hajianpour | 128/25 R |
| 4,679,548 | 7/1987 | Pecheux | 128/26 |
| 4,724,827 | 2/1988 | Schenck | 128/26 |
| 4,822,027 | 4/1989 | Kascak | 128/26 X |
| 4,962,756 | 10/1990 | Shamir et al. | 128/26 |

*Primary Examiner*—Robert Bahr
*Assistant Examiner*—Linda C. M. Dvorak

[57] ABSTRACT

A device for providing continuous passive motion therapy to a patient's wrist comprises a base removably attached to the forearm of the patient rearwards of the wrist. The base includes horizontal turntable which can be secured thereon in a selected position. A wheel driven by a motor is rotatably mounted on the turntable for rotation in a vertical plane. A telescopic motion transmission which is provided between the wheel and a handle is mounted eccentrically to an eccentric disk which in turn is eccentrically and parallely mounted on the wheel. The eccentric disk may be rotated relative to the wheel to vary the absolute eccentricity of the motion transmission with respect to the rotation axis of the wheel. The handle which is universally mounted to the motion transmission includes a grip. Therefore, a rotation of the wheel and thus of the eccentric disk caused the motion transmission to pivot and to impart to the patient's hand a preselected pivoting motion about the wrist being treated. The present invention can also be adapted to other joints, such as ankles.

20 Claims, 3 Drawing Sheets

CONTINUOUS PASSIVE MOTION DEVICE

BACKGROUND OF THE INVENTION

1. Field of the Invention

The present invention relates to continuous passive motion devices and, more particularly, to such a device intended for wrist therapy.

Various devices have been contemplated to rehabilitate a wrist or a finger through continuous passive motion therapy.

2. Description of the Prior Art

Enzler U.S. Pat. No. 1,833,357, on Nov. 24, 1931, discloses a series of levers connecting a camshaft to a plurality of finger exercisers each forming a trough of semicircular cross-section for attachment to the fingers to be exercised. This combination provides for a planar pivoting motion of the fingers upon rotation of the camshaft. As an alternative, the camshaft and lever arrangement is replaced by a shaft provided with a plurality of eccentric disks each contacting the underside of one of the finger exercisers to again produce a planar pivoting motion to the fingers.

Farris et al U.S. Pat. No. 4,474,176, on Oct. 2, 1984, discloses an apparatus for articulating a person's foot relative to the person's lower leg, that is about the ankle thereof. This foot articulator comprises a foot supporting plate having upwardly extending arms on each side thereof pivotally connected to the lower end of a longitudinally extending frame which is secured to the lower leg. A motor mounted to the upper end of the frame is connected to the foot support to cause the same to reciprocate back and forth relative to the frame upon actuation of the motor. The connection between the motor and the foot support includes a wishbone-shaped yoke whose lower legs are pivotally connected to opposite sides of the foot support. This device thus allows for a vertical planar pivoting motion of the foot generally in the plane of the lower leg and the foot.

Other devices have also been developed but, as above, all of these therapeutic finger, wrist, toe and ankle rehabilitating devices only provide a two-dimensional exercise capability. These devices cannot be differently oriented to impart various therapeutic motions to the joint being exercised.

SUMMARY OF THE INVENTION

It is therefore an aim of the present invention to provide a continuous passive motion device for wrist rehabilitation which is adapted for allowing various therapeutic motions to the wrist being exercised.

A construction in accordance with the present invention comprises a device for providing continuous passive motion therapy to a wrist of a patient. The device comprises a base, an attachment means for removably attaching the base to a forearm of the patient rearwards of the wrist for allowing a pivot thereof. The device also comprises a wheel means rotatably mounted on the base and adapted to be oriented and secured for rotation in a selected one of various planes. A motor means is provided for driving the wheel means. A motion transmission means is provided between the wheel means and the hand of the patient. The transmission means is mounted eccentrically to the wheel means. The wheel means and the transmission means are adapted to impart upon actuation of the motor means a preselected pivoting motion to the wrist.

In a more specific construction in accordance with the present invention, the motion transmission means comprises an elongated member pivotally mounted at opposite ends thereof respectively to the wheel means and to a handle means. The elongated member is pivotally mounted between the opposite ends thereof to an upper end of a trunnion means extending upwards from the base.

In a still more specific construction in accordance with the present invention, the elongated member comprises a tubular shaft pivotally mounted at opposite first and second ends thereof respectively to the trunnion means and to the handle means. A telescopic rod is pivotally mounted at a first end thereof to the wheel means and is slidably engaged at a second end thereof in the tubular shaft.

In a still more specific construction in accordance with the present invention, the base comprises a horizontal turntable means rotatably mounted thereon and adapted to be secured thereon in a selected position. The wheel means is mounted on the turntable means and is adapted for rotation in a vertical plane. Therefore, the turntable means is selectively positioned for orienting a plane of rotation of the wheel means relative to the elongated member.

In a still more specific construction in accordance with the present invention, the tubular shaft is mounted to the trunnion means for pivoting in a vertical plane. The trunnion means is rotatably mounted at a lower end thereof to the base for horizontal rotation thereon.

In a still more specific construction in accordance with the present invention, a disk means is eccentrically mounted to the wheel means and is parallel thereto. The first end of the telescopic rod is pivotally and eccentrically mounted to the disk means. The disk means is adapted for rotation with respect to the wheel means and is adapted to be secured thereon in a selected position thereby providing various absolute eccentricities of the first end of the telescopic rod with respect to a rotation axis of the wheel means. Therefore, the amplitude of the pivot of the elongated member can be varied.

In a still more specific construction in accordance with the present invention, the motor means is encased in a housing mounted on the turntable means. The wheel means is adapted to rotate within an annular ring fixedly mounted to the housing. Furthermore, the motor means drives a first gear wheel mounted in the housing and in meshed engagement through an opening defined in the annular ring with a second gear wheel fixedly mounted in the wheel means.

In a still more specific construction in accordance with the present invention, the handle means comprises a universal joint means mounted to the second end of the tubular shaft. A generally C-shaped shaft is rotatably mounted at opposite ends thereof to the universal joint means and to a grip means adapted to be grasped by the hand of the patient.

A further construction in accordance with the present invention comprises a device for providing continuous passive motion therapy to a joint of the body of a patient. The device comprises a base, an attachment means for removably attaching the base to the body on one side of the joint for allowing a pivot thereof. A wheel means is rotatably mounted on the base and is adapted to be oriented and secured for rotation in a selected one of various planes. A motor means drives the wheel means and a motion transmission means is provided between the wheel means and the body at the other side of the joint. The transmission means is mounted eccentrically to the wheel means. The wheel means and the transmission means are adapted to impart upon actuation of the motor means a preselected pivoting motion to the joint.

BRIEF DESCRIPTION OF THE DRAWINGS

Having thus generally described the nature of the invention, reference will now be made to the accompanying drawings showing by way of illustration a preferred embodiment thereof, and wherein.

DESCRIPTION OF THE PREFERRED EMBODIMENTS

Figure 1:
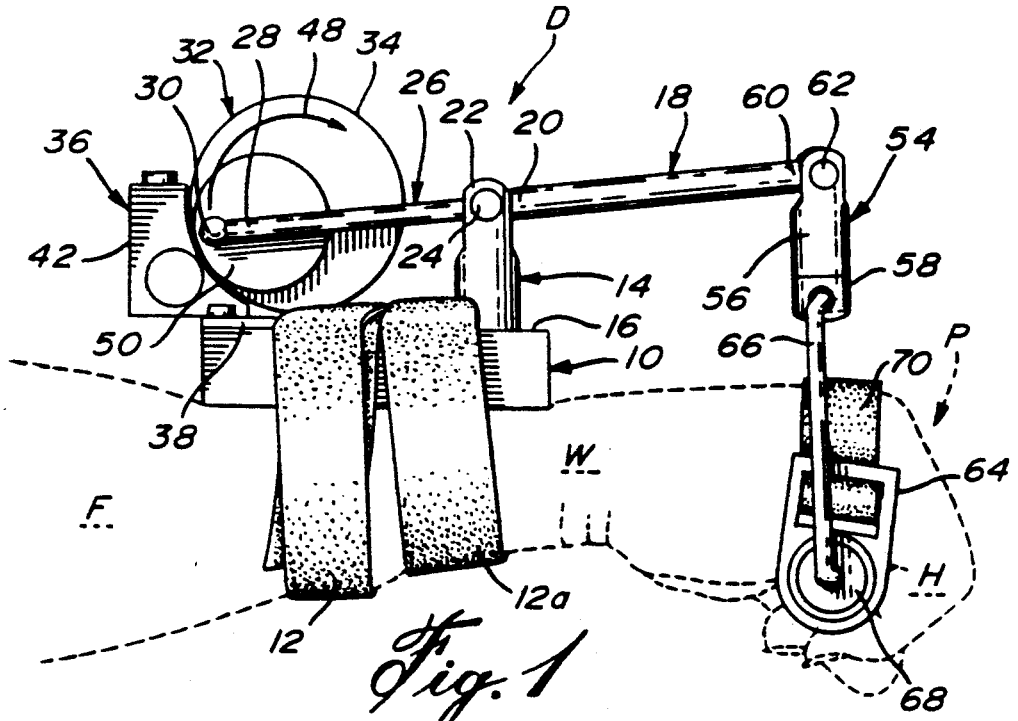
FIG. 1 is a side elevation illustrating a continuous passive motion device in accordance with the present invention in a first setting thereof for imparting a vertical pivoting motion to a wrist of a patient.

FIG. 1 illustrates a continuous passive motion device D in accordance with the present invention which includes a base 10 provided with a pair of straps 12 and 12*a*. The base 10 which is of rectangular shape is positioned on top of a forearm F of a patient P rearwards of a wrist W in order to allow the same to pivot. The base 10 is then secured to the forearm F by way of the straps 12 and 12*a* which are tightened around the forearm F.

A trunnion 14 which extends upwards at right angles from a front part of a top surface 16 of the base 10 is rotatably mounted to the base 10 in order to rotate about its axis. A tubular shaft 18 is pivotally mounted at a rear end 20 thereof to a top end 22 of the trunnion 14 thus forming a pivot at 24 in order that the tubular shaft 18 may pivot in a vertical plane. The pivot 24 in conjunction with the rotation of the trunnion 14 with respect to the base 10 provides a universal joint which allows the tubular shaft 18 to pivot tridimensionally.

A telescopic rod 26 is engaged in the tubular shaft 18 through the rear end 20 thereof. The telescopic rod 26 is connected at a rear end 28 thereof by a pivot 30 to an eccentric transmission generally indicated by 32. The eccentric transmission 32 includes a vertical wheel 34 which is driven by a motor 36 in a way which will be described hereinafter.

Figure 2:
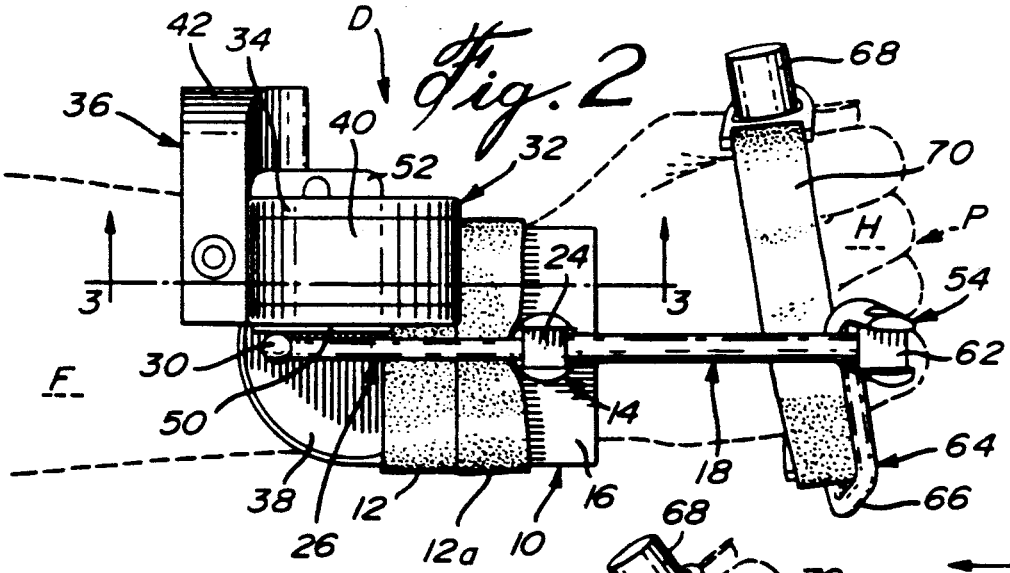
FIG. 2 is a top plan view of the device of FIG. 1.
Figure 3:
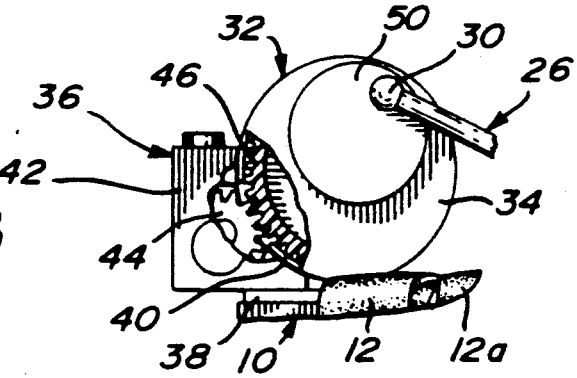
FIG. 3 is a partly fragmented cross-sectional side view taken along lines 3—3 of FIG. 2.

As best seen in FIG. 2, the combination of the eccentric transmission 32 and the motor 36 is rotatably mounted on a horizontal turntable 38 provided at the rear of the base 10. The vertical wheel 34 is slidable within an annular ring 40 fixedly mounted to a housing 42 of the motor 36. The motor 36 drives a first gear wheel 44 provided in the housing 42 thereof and which is in meshed engagement with a second gear wheel 46 fixedly mounted within the vertical wheel 34, as best seen in FIG. 3. At the point of engagement of the gear wheels 44 and 46, a slot is defined through the annular ring 40. Furthermore, a peripheral slot provided centrally along the entire perimeter of the vertical wheel 34, in fact separates the vertical wheel 34 in two distinct halves which are connected one to the other by a central shaft (not shown). This peripheral slot which underlies the annular ring 40 is defined opposite the second gear wheel 46 to permit the first and second gear wheels 44 and 46 to mesh along the complete rotation of the vertical wheel 34 within the annular ring 40.

Therefore, upon actuation of the motor 36, the first gear wheel 44 drives the second gear wheel 46 and therefore the vertical wheel 34 within the annular ring 40 in a direction such as that shown by arrow 48 in FIG. 1.

Figure 5:
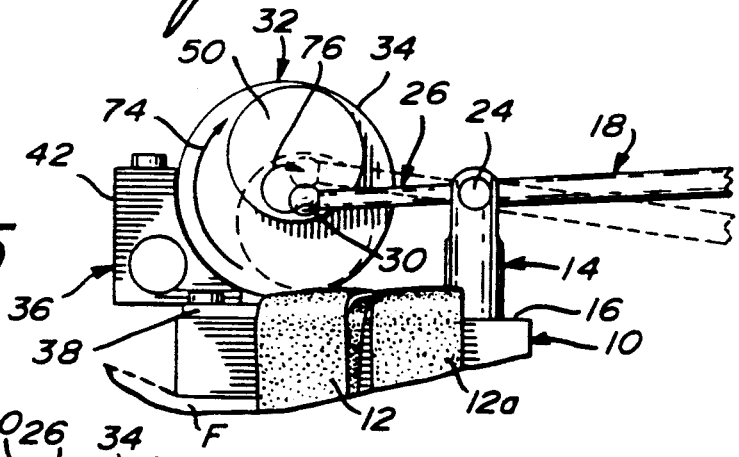
FIG. 5 is a side elevation similar to FIG. 4 but wherein the device is positioned to provide a pivoting motion to the wrist of less amplitude than that of FIG. 4.

An eccentric disk 50 is mounted eccentrically through the vertical wheel 34. The telescopic rod 26 is pivotally mounted at 30 to the eccentric disk 50 near the periphery thereof, as seen in FIG. 1. Now referring to FIG. 2, the eccentric disk 50 is secured into position with respect to the vertical wheel 34 by way of a screw 52 which, when loosened, allows the eccentric disk 50 to be rotated about its axis within the vertical wheel 34. FIGS. 1 and 5 show two different positions of the eccentric disk 50 with respect to the vertical wheel 34.

Now referring to FIGS. 1 and 2, a swivel 54 includes upper and lower sections 56 and 58 respectively rotatably mounted one to the other. The upper section 56 of the swivel 54 is pivotally mounted to a front end 60 of the tubular shaft 18 at pivot 62. A handle 64 suspended from the swivel 54 includes a shaft 66 journaled at opposite ends thereof in the lower section 58 of the swivel 54 and in an elongated grip 68. A strap 70 is provided on the grip 68 in order that, when the grip 68 is grasped by a hand H of the patient P, the strap 70 can be passed over the back of the hand H thereby further securing the same to the handle 64.

Various wrist motions will be obtained depending on the position of the turntable 38 and thus of the vertical wheel 34 with respect to the base 10 and also depending on the relative position of the eccentric disk 50 on the vertical wheel 34. It is noted that the positioning of the horizontal turntable 38 is adjusted with respect to the base 10 and secured thereto by an arrangement (not shown) similar to the screw 52 for positioning the eccentric disk 50 relative to the vertical wheel 34.

Figure 4:
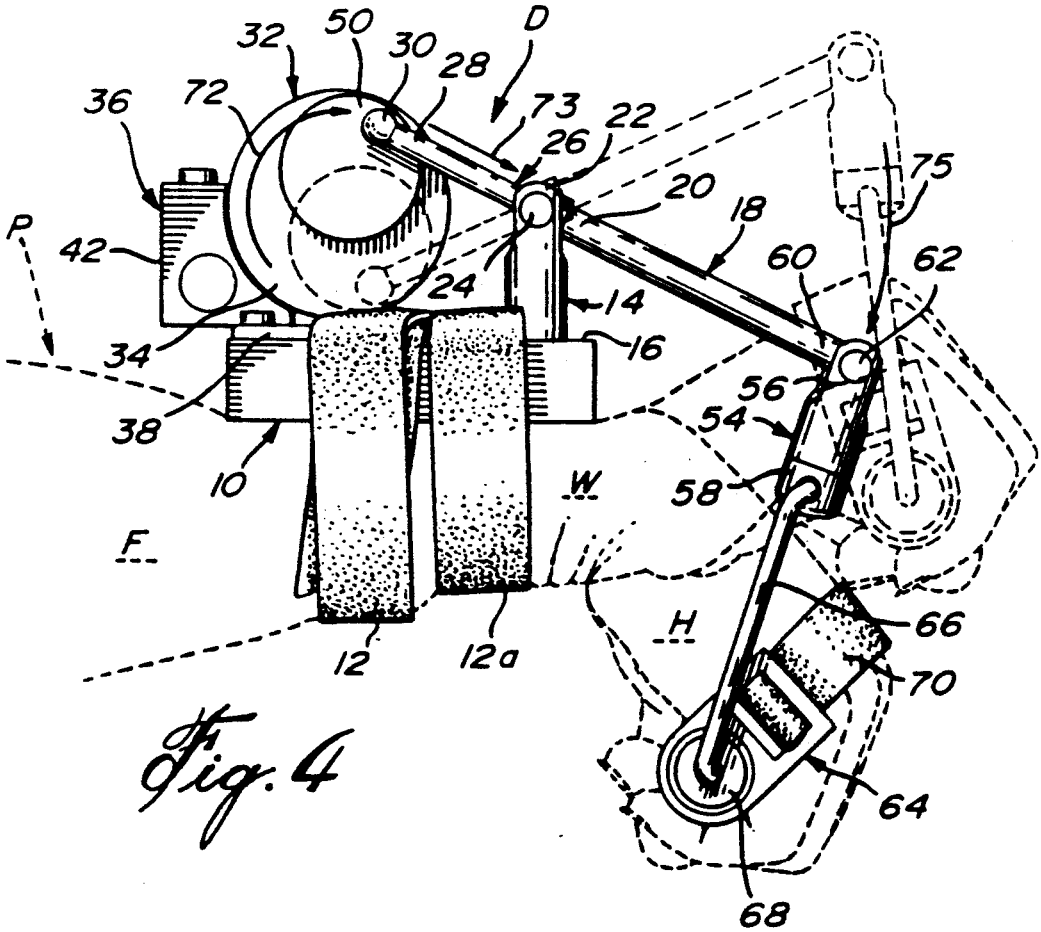
FIG. 4 is a side elevation similar to FIG. 1 as the device is in its first setting but showing a pair of further positions of the wrist.

In FIGS. 1, 2, 3 and 4, the turntable 38 is positioned in order that the plane of the vertical wheel 34 is generally parallel to the axis of the forearm F. Rotation of the vertical wheel 34 will displace the eccentric disk 50 in directions shown by arrow 48 in FIG. 1 and arrow 72 in FIG. 4. The ensuing displacement of the pivot 30 will cause the telescopic rod 26 to pivot thereby forcing a similar pivot of the tubular shaft 18 about the pivot 24 with the telescopic rod 26 telescoping in and out of the tubular shaft 18 as required. In FIG. 4, the rotation of the eccentric disk along arrow 72 forces the telescopic rod 26 to displace along arrow 73 into the tubular shaft 18 with the same pivoting downwards along with the hand H of the patient P as indicated by arrow 75. The pivot of the tubular shaft 18 will produce a pivoting motion in a vertical plane of the handle 64 and thus of the hand H of the patient P. The wrist W will thus also flex up-and-down in a two-dimensional motion.

Now referring to FIG. 5, the eccentric disk 50 by way of the screw 52 has been positioned with respect to the vertical wheel 34 in order that the pivot 30 is closer to the center of the vertical wheel 34 than in FIGS. 1 through 4, whereby the amplitude of the pivot of the telescoping rod 26, the tubular shaft 18, the handle 64, the hand H and thus the wrist W is reduced. Rotation of the vertical wheel 34 in the direction shown by arrow 74 will cause the pivot 30 to rotate in a direction shown by arrow 76. It is thus easily understood that the eccentric disk 50 is positioned relative to the vertical wheel 34 depending on the desired angle of pivot of the wrist W.

Figure 6:
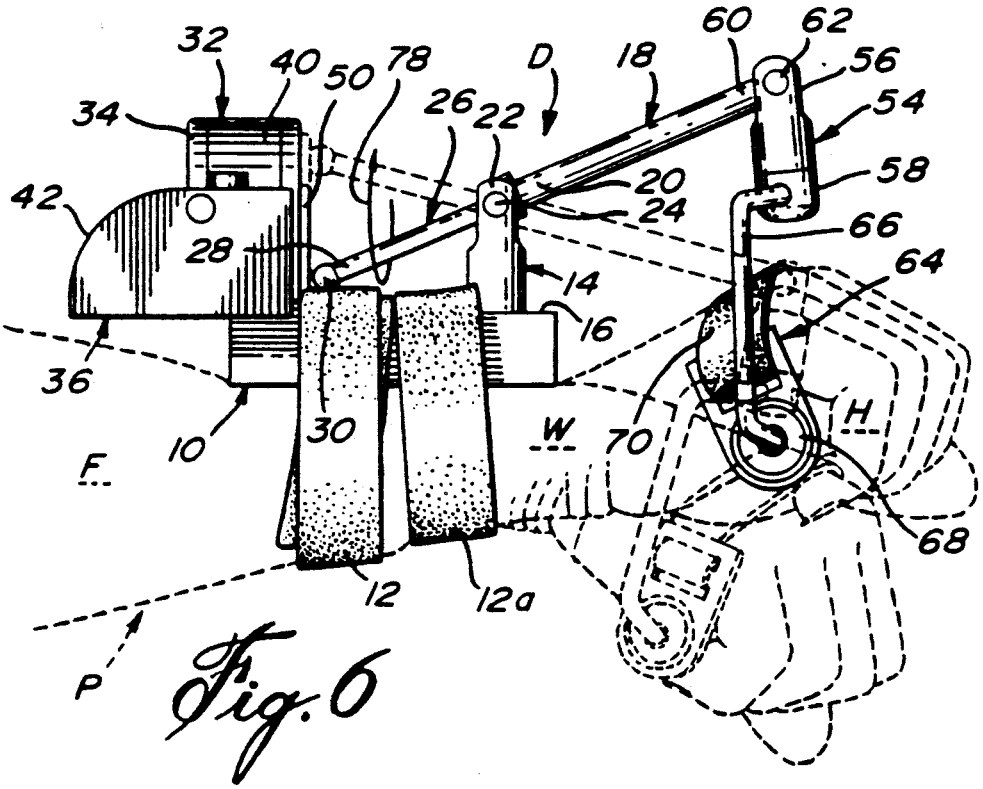
FIG. 6 is a side elevation of the device of FIG. 1 but in a second setting thereof for imparting a circular motion to the wrist.

Now referring to FIG. 6, the turntable 38 is positioned so that the plane of the vertical wheel 34 is generally at right angles to the axis of the forearm F. Therefore, rotation of the vertical wheel 34 and thus the eccentric disk 50 will cause the telescopic rod 26 to pivot so as to provide a locus describing a circle, as indicated by arrow 78, thereby imparting a circular motion to the hand H in a plane generally parallel to that of the vertical wheel 34 and at right angles to the axis of the forearm F. Again, although not shown, the diameter of the circle defined by the hand H depends on the relative position of the eccentric disk 50 to the vertical wheel 34, that is the distance between the pivot 30 and the center of the vertical wheel 34.

Figure 8:
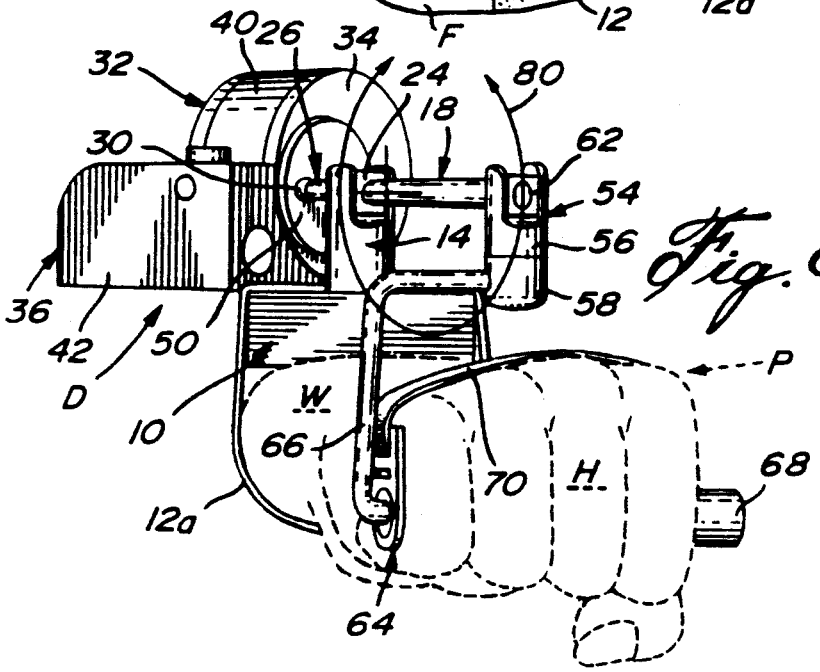
FIG. 8 is a front elevation from lines 8—8 of FIG. 7.
Figure 7:
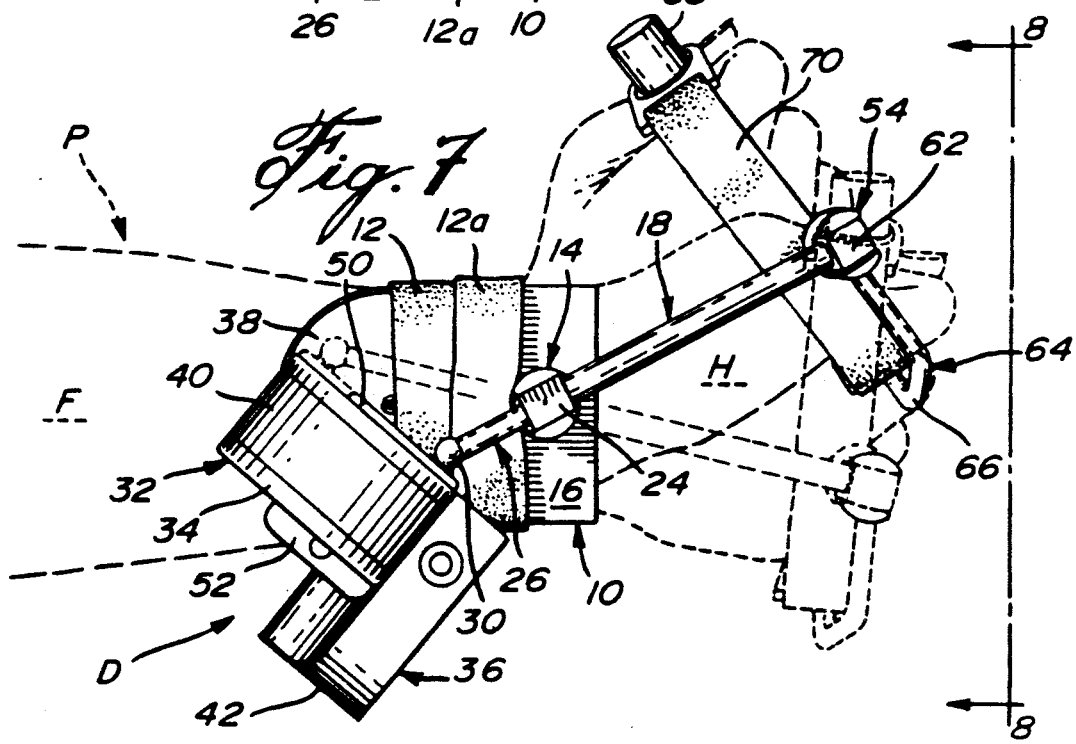
FIG. 7 is a top plan view of the device of FIG. 1 in a third setting thereof for imparting an ellipsoidal motion to the wrist.

Now referring to FIGS. 7 and 8, the turntable 38 has been positioned in order that the axis of the forearm F intersects the plane of the vertical wheel 34 at an oblique angle. Rotation of the vertical wheel 34 will cause the swivel 54 to rotate in the general direction shown by arrow 80 thereby imparting a lopsided oval motion to the hand H and to the wrist W.

Such an arrangement as shown in FIGS. 7 and 8 of the turntable 38 and thus of the vertical wheel 34 allows for a motion of the hand H which takes into account the greater inward natural horizontal flexion of the hand H at the wrist W with respect to the opposite outward natural horizontal flexion thereof. Therefore the present continuous passive motion device D emulates as closely as possible the natural wrist movement during the exercise.

In this preferred embodiment, the base 10, the vertical wheel 34, the lower section 58 of the swivel 54 and the grip 68 are all made of a plastics material such as nylon. On the other hand, the trunnion 14, the tubular shaft 18, the telescopic rod 26, the annular ring 40, the motor housing 42, the eccentric disk 50, the upper section 56 of the swivel 54 and the shaft 66 of the handle 64 are all made of stainless steel. We notice that the nylon vertical wheel rotates within the stainless steel annular ring 40, that the stainless steel eccentric disk 50 can be rotated within the nylon vertical wheel 34, that the stainless steel trunnion 14 rotates onto the nylon base 10, that the stainless steel upper section 56 of the swivel 54 rotates against the nylon lower section 58 thereof and that the stainless steel shaft 66 of the handle 64 rotates within the nylon lower section 58 of the swivel 54 and within the nylon grip 68. Friction is reduced by having nylon surfaces bearing against stainless steel surfaces.

As an alternative transmission, it is readily seen that the rear end 20 of the tubular shaft 18 could be rigidly mounted to the middle portion of the trunnion 14 with the pivot of the tubular shaft 18 in various vertical planes being ensured by having the trunnion 14 pivotally mounted at its lower end to the base 10. In such a case, the telescopic rod 26 would be pivotally mounted to the top end 22 of the trunnion 14 and could telescope in and out thereof.

From the above, it is easily understood that the turntable 38 can be positioned to orient the telescoping rod 26 and the tubular shaft 18 to impart thereto anything from a two-dimensional pivoting thereof to a locus in the form of a compound loop. The universal joints formed by the trunnion 14 and the swivel 54 allow for the pivot of the tubular shaft 18 as the vertical wheel 34 rotates. Furthermore, the shaft 66 of the handle 64 allows both the handle 64 to rotate with respect to the swivel 54 and the grip 66 to rotate.

Therefore, the present continuous passive motion device D provides for a multitude of therapeutic wrist motions in order to properly rehabilitate an injured wrist. None of the known devices can produce such tridimensional motions.

Finally, it is easily understood that the above device is intended for rehabilitating wrists but it could be modified to provide continuous passive motion therapy to other joints of the body, such as the ankle.

I claim:

1. A device for providing continuous passive motion therapy to a wrist of a patient comprising a base, attachment means for removably attaching said base to a forearm of the patient rearwards of the wrist for allowing a pivot thereof, an upstanding wheel means mounted on said base and adapted to be relatively oriented and secured thereon for rotation in various planes which at least include one plane which is oblique to a general longitudinal axis of the forearm, motor means driving said wheel means, and an elongated motion transmission means provided between said wheel means and the hand of the patient, said transmission means being mounted eccentrically to said wheel means, said wheel means and said transmission means being adapted to impart upon actuation of said motor means various pivoting motions to the wrist which depend on the selected rotation plane of said wheel means relative to said base and which include, for said one plane, an ellipse-shaped motion.

2. A device as defined in claim 1, wherein said motion transmission means comprises an elongated member pivotally mounted at opposite ends thereof respectively to said wheel means and to a handle means, said elongated member being pivotally mounted between said opposite ends thereof to an upper end of a trunnion means extending at right angles from said base, said various planes ranging from a plane substantially perpendicular to said axis of the forearm to a plane substantially parallel thereto, whereby a rotation of said wheel means drives said motion transmission means along two axes of motion into an elliptical orbit with one of said axes being adjustable between zero wherein the hand is displaced in a reciprocal arcuate motion and a maximum wherein the hand is displaced in a circular motion in a plane perpendicular to said axis of the forearm.

3. A device as defined in claim 2, wherein said elongated member comprises a tubular shaft pivotally mounted at opposite first and second ends thereof respectively to said trunnion means and to said handle means, and a telescopic rod pivotally mounted at a first end thereof to said wheel means and slidably engaged at a second end thereof in said tubular shaft.

4. A device as defined in claim 1, wherein said base comprises turntable means rotatably mounted thereon and adapted to be secured thereon in a selected position, said wheel means being mounted at right angles on said turntable means and being adapted for rotation in said various planes, whereby said turntable means is selectively positioned for orienting a plane of rotation of said wheel means relative to said transmission means.

5. A device as defined in claim 3, wherein said tubular shaft is mounted to said trunnion means for pivoting in planes perpendicular to a plane of the hand of the patient, and wherein said trunnion means is rotatably mounted at a lower end thereof to said base for rotation thereon in said plane of the hand.

6. A device as defined in claim 3, wherein a disk means is eccentrically mounted to said wheel means and is parallel thereto, said first end of said telescopic rod being pivotally and eccentrically mounted to said disk means, said disk means being adapted for rotation with respect to said wheel means and being adapted to be secured thereon in a selected position thereby providing various absolute eccentricities of said first end of said telescopic rod with respect to a rotation axis of said wheel means, whereby the amplitude of the pivot of said elongated member can be varied.

7. A device as defined in claim 4, wherein said motor means is encased in a housing mounted on said turntable means, and wherein said wheel means is adapted to rotate within an annular ring fixedly mounted to at least one of said housing and said turntable means.

8. A device as defined in claim 7, wherein said motor means drives a first gear wheel mounted in said housing and in meshed engagement through an opening defined in said annular ring with a second gear wheel fixedly mounted in said wheel means.

9. A device as defined in claim 3, wherein said handle means comprises universal joint means mounted to said second end of said tubular shaft, a generally C-shaped shaft rotatably mounted at opposite ends thereof to said universal joint means and to a grip means adapted to be grasped by the hand of the patient.

10. A device as defined in claim 9, wherein said grip means comprises strap means adapted to pass around a back part of the hand thereby forming a closed loop around the hand for securing the hand to said handle means.

11. A device as defined in claim 1, wherein said attachment means comprises at least one strap adapted for forming with said base a closed loop around the forearm of the patient for securing said device thereto.

12. A device for providing continuous passive motion therapy to a joint of a patient's body comprising a base, attachment means for removably attaching said base to a first member of the body located on one side of the joint for allowing a pivot thereof, an upstanding wheel means mounted on said base and adapted to be relatively oriented and secured thereon for rotation in various planes which at least include one plane which is oblique to a general longitudinal axis of the first member, motor means driving said wheel means, and an elongated motion transmission means joining said wheel means and a second member of the body located on the other side of the joint, said transmission means being mounted eccentrically to said wheel means, said wheel means and said transmission means being adapted to impart upon actuation of said motor means various pivoting motions to the joint which depend on the selected rotation plane of said wheel means relative to said base and which include, for said one plane, an ellipse-shaped motion.

13. A device as defined in claim 12, wherein said motion transmission means comprises an elongated member pivotally mounted at opposite ends thereof respectively to said wheel means and to a removable connection means to the second member, said elongated member being pivotally mounted between said opposite ends thereof to an upper end of a trunnion means extending at right angles from said base, said various planes ranging from a plane substantially perpendicular to said axis of the first member to a plane substantially parallel thereto, whereby a rotation of said wheel means drives said motion transmission means along two axes of motion into an elliptical orbit with one of said axes being adjustable between zero wherein the second member is displaced in a reciprocal arcuate motion and a maximum wherein the second member is displaced in a circular motion in a plane perpendicular to said axis of the first member.

14. A device as defined in claim 13, wherein said elongated member comprises a tubular shaft pivotally mounted at opposite first and second ends thereof respectively to said trunnion means and to said connection means, and a telescopic rod pivotally mounted at a first end thereof to said wheel means and slidably engaged at a second end thereof in said tubular shaft.

15. A device as defined in claim 12, wherein said base comprises turntable means rotatably mounted thereon and adapted to be secured thereon in a selected position, said wheel means being mounted at right angles on said turntable means and being adapted for rotation in said various planes, whereby said turntable means is selectively positioned for orienting a plane of rotation of said wheel means relative to said transmission means.

16. A device as defined in claim 14, wherein said tubular shaft is mounted to said trunnion means for pivoting in planes perpendicular to a plane of said base, and wherein said trunnion means is rotatably mounted at a lower end thereof to said base for rotation thereon in said plane of said base.

17. A device as defined in claim 14, wherein a disk means is eccentrically mounted to said wheel means and is parallel thereto, said first end of said telescopic rod being pivotally and eccentrically mounted to said disk means, said disk means being adapted for rotation with respect to said wheel means and being adapted to be secured thereon in a selected position thereby providing various absolute eccentricities of said first end of said telescopic rod with respect to a rotation axis of said wheel means, whereby the amplitude of the pivot of said elongated member can be varied.

18. A device as defined in claim 15, wherein said motor means is encased in a housing mounted on said turntable means, and wherein said wheel means is adapted to rotate within an annular ring fixedly mounted to at least one of said housing and said turntable means.

19. A device as defined in claim 18, wherein said motor means drives a first gear wheel mounted in said housing and in meshed engagement through an opening defined in said annular ring with a second gear wheel fixedly mounted in said wheel means.

20. A device as defined in claim 12, wherein said attachment means comprises at least one strap adapted for forming with said base a closed loop around the second member of the patient for securing said device thereto.

* * * * *

UNITED STATES PATENT AND TRADEMARK OFFICE

CERTIFICATE OF CORRECTION

PATENT NO. : 5,067,479

DATED : November 26, 1991

INVENTOR(S) : John Saringer et al.

It is certified that error appears in the above-identified patent and that said Letters Patent is hereby corrected as shown below:

On the title page:

Item [30] Foreign Application Priority:

August 17, 1990 [CA]
Canada 2,023,505

Signed and Sealed this

Fifth Day of March, 1996

Bruce Lehman

*Attest:*

BRUCE LEHMAN

*Attesting Officer*

*Commissioner of Patents and Trademarks*